United States Patent [19]

Welsh et al.

[11] 4,203,339

[45] May 20, 1980

[54] BRASS KEYER SYSTEM FOR ELECTRONIC ORGAN

[75] Inventors: Alan B. Welsh; John W. Robinson, both of Jasper, Ind.

[73] Assignee: Kimball International, Inc., Jasper, Ind.

[21] Appl. No.: 893,872

[22] Filed: Apr. 6, 1978

[51] Int. Cl.[2] ..... G10H 1/02; G10H 5/10

[52] U.S. Cl. ..... 84/1.19; 84/1.24; 84/1.25; 84/DIG. 23

[58] Field of Search ..... 84/1.11–1.13, 84/1.19, 1.21, 1.24–1.27, DIG. 7, DIG. 8, DIG. 23, 1.01; 307/268

[56] References Cited

U.S. PATENT DOCUMENTS

| | | | |
|---|---|---|---|
| 2,861,187 | 11/1958 | De Vita | 84/1.01 X |
| 3,223,768 | 12/1965 | Munch, Jr. et al. | 84/1.01 |
| 3,569,604 | 3/1971 | Schwartz et al. | 84/1.01 |
| 3,580,980 | 5/1971 | Uetrecht | 84/1.24 X |
| 3,622,808 | 11/1971 | Uchida | 307/268 |
| 3,715,445 | 2/1973 | Kniepkamp | 84/1.13 |
| 3,767,834 | 10/1973 | Hebeisen et al. | 84/1.19 |
| 4,018,123 | 4/1977 | Sugiura | 84/1.24 X |

*Primary Examiner*—S. J. Witkowski

*Attorney, Agent, or Firm*—Albert L. Jeffers; John F. Hoffman

[57] ABSTRACT

A keying arrangement for electronic organs in which a tone signal consisting of a square wave having, for example, a fifty percent duty cycle is connected to the input of the keyer circuit, and the output thereof, upon the depression of a playing key, consists of a pulse train with the amplitude rising at a controlled rate and the pulse width or duty cycle decreasing at a controlled rate but lagging the increase in amplitude so as to closely duplicate the playing of a muted brass instrument in the attack fashion. A muted brass tremulant affect is achieved by applying a cyclically time variant signal to modulate the pulse amplitude and pulse duty cycle, again with the change in duty cycle lagging the change in amplitude. The circuitry for accomplishing this comprises a diode keyer wherein a pair of resistor-capacitor circuits having different time constants control the keyer to effect variations in pulse amplitude and duty cycle over respective intervals of time.

23 Claims, 3 Drawing Figures

FIG. 1
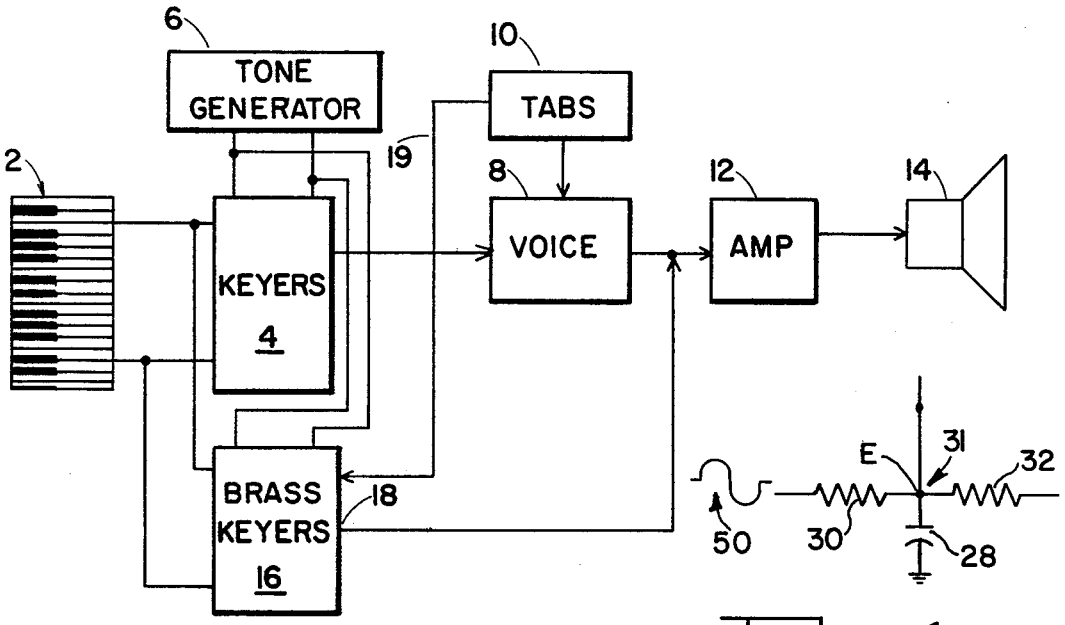
FIG. 4
FIG. 2
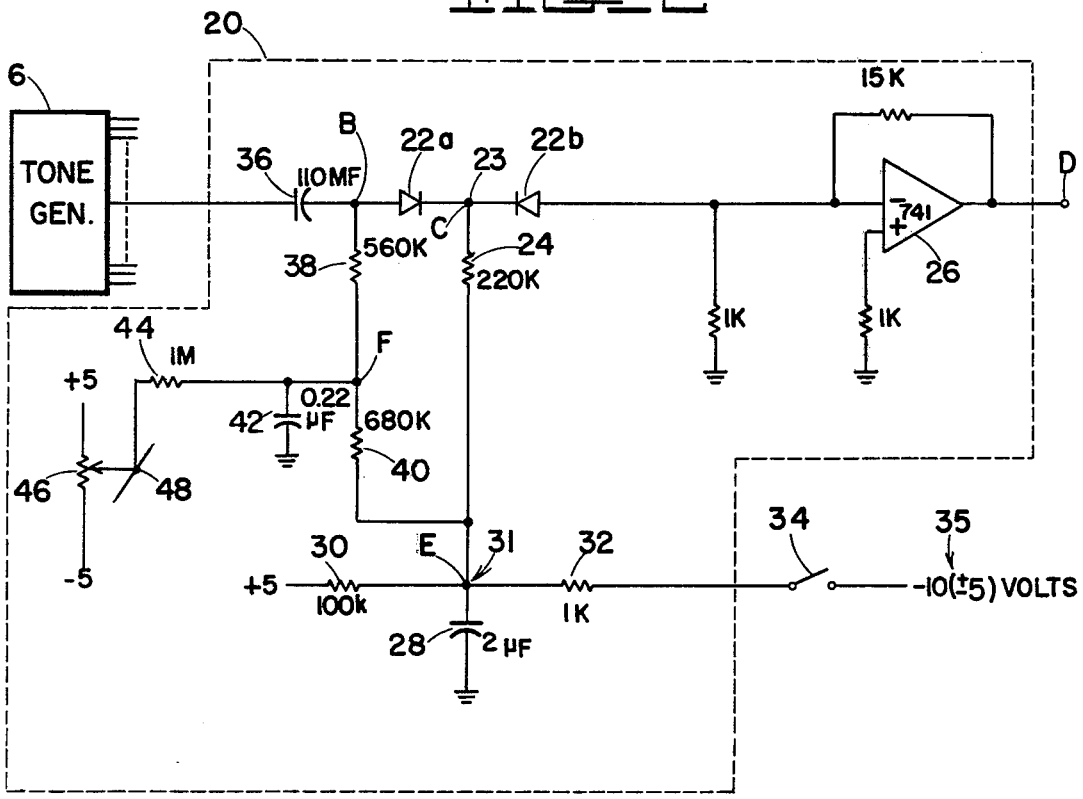

BRASS KEYER SYSTEM FOR ELECTRONIC ORGAN

BACKGROUND OF THE INVENTION

The present invention relates to a pulse forming circuit with delayed pulse width control and in particular to a circuit wherein the change in pulse width lags the change in pulse amplitude so as to produce muted brass voices in electronic organs.

It has been established that the tonal quality of a note from a musical instrument is dependent upon the harmonic content of the wave form of the note. Brass instruments, in particular, contain harmonics in nearly equal portions, that is, the amplitude of the harmonics of a note from a brass instrument do not fall off sharply in amplitude with increasing frequency. A square wave with narrow pulse width has a harmonic structure whereby the amplitudes of the harmonics are approximately equal so that the tone is very bright and is a suitable wave form for producing brass voices. A wider pulse possesses a decrease in amplitude for increasingly higher harmonics relative to the amplitude of the fundamental and the tone is more mellow than that of the narrow pulse.

When a key in an electronic organ is depressed, the sound of a brass instrument to be synthesized should build in amplitude and harmonic structure but, to closely copy an actual brass instrument in which the player may change the tonal quality by changing lip pressure, the tonal quality of the sound may lag slightly the initial increase of amplitude. This effect is most pronounced when a mute is used with a trumpet or trombone wherein the mute is removed after wind pressure is applied to the horn and thus a mellow sound is first heard and then a brighter sound follows.

SUMMARY OF THE INVENTION

The present invention relates to a keying system for use in electronic organs to achieve a muted brass effect and in which the amplitude of the keyed tone signal is allowed to increase to its maximum value at a controlled rate, while the duty cycle thereof is varied from a higher value to a lower value at a second controlled rate lower than the rate at which the amplitude increases. The initial tone signal consists of square waves having a duty cycle of, for example, fifty percent which are fed to the input of a keyer circuit consisting of a diode pair and a source of bias voltage. The bias voltage is applied to the diode pair under the control of a key switch or keyer activating signal from the demultiplexer circuit, with the rate of change from the switch-open state, or non-actuated state, to the switch-closed state, or actuated state, controlled by a resistor-capacitor pair. This general type of keyer circuit is disclosed in U.S. Pat. No. 3,389,211 owned by the assignee herein.

This keyer arrangement is modified, however, by a wave shaping circuit connected between the input to the diode pair and the square wave tone source which partially differentiates the square wave. The degree of differentiation and the slope of the resulting wave are controlled by a second bias voltage which is also controlled by the key operated switch or demultiplexer output and has a second resistor-capacitor pair for determining the time constant of the change from the switch open state to the switch closed state. The differentiating portion of the keyer circuit determines the pulse width, or duty cycle, of the signal passed by the keyer, while the bias circuit of the diode pair controls the amplitude of the signal passed by the keyer. Although the same key switch activates both portions of the keyer circuit, the time constants for the two portions of the keyer are fully independent, allowing very flexible and accurate adjustment of the amplitude and pulse width of the resulting tone signal.

Specifically, the present invention contemplates a keyer system for an electronic musical instrument comprising: a square wave signal frequency source, an output terminal, and control means interposed between the source and output terminal and responsive to the source of signal for supplying a square wave signal to the output terminal, the signal supplied to the output terminal being of the same frequency as the source signal. The control means further includes means for continuously changing the amplitude of the signal produced thereby in one direction over a first interval of time and for continuously changing the duty cycle of the signal produced thereby in one direction over a second interval of time, at least a portion of a second interval being delayed in time from the first interval.

The present invention also contemplates a method of producing a muted brass effect in an electronic organ by providing a source of square wave frequency to an input terminal, causing the amplitude of the square wave frequency to change in one direction over an interval of time, and causing the duty cycle to change in one direction over an interval of time with the change in duty cycle lagging the change in amplitude.

It is an object of the present invention to provide a brass keyer circuit having a pulse forming and gating function and a delayed change in the duty cycle of the pulse train produced thereby in relation to the amplitude build up so as to closely duplicate the playing of a brass instrument in the attack fashion as well as in muted tremulant playing.

It is a further object of the present invention to provide a brass keyer circuit for an electronic musical instrument wherein the duty cycle change is not simultaneous with the amplitude change.

Another object of the present invention is to provide a brass keyer circuit for an electronic musical instrument wherein the change in duty cycle at the onset of the signal produced by the depression of a playing key has a relatively wide dynamic range in relationship to the remainder of the signal change and, furthermore, in concurrent with the relatively short interval of the change from initial to final pulse amplitude.

Yet another object of the present invention is to provide a keyer circuit for electronic musical instruments which closely simulates brass instruments and which is compatible with the use of square wave tone generating means.

These and other objects and advantages of the present invention will be more fully understood by reference to the detailed description taken together with the accompanying drawings.

BRIEF DESCRIPTION OF THE DRAWINGS

FIG. 1 is a simplified block diagram of a portion of an organ embodying the circuit of the present invention;

FIG. 2 is a schematic diagram of a keyer circuit according to the present invention;

FIG. 4 shows a modification to the schematic of FIG. 2 to produce a tremulant effect.

DETAILED DESCRIPTION

Figure 3:
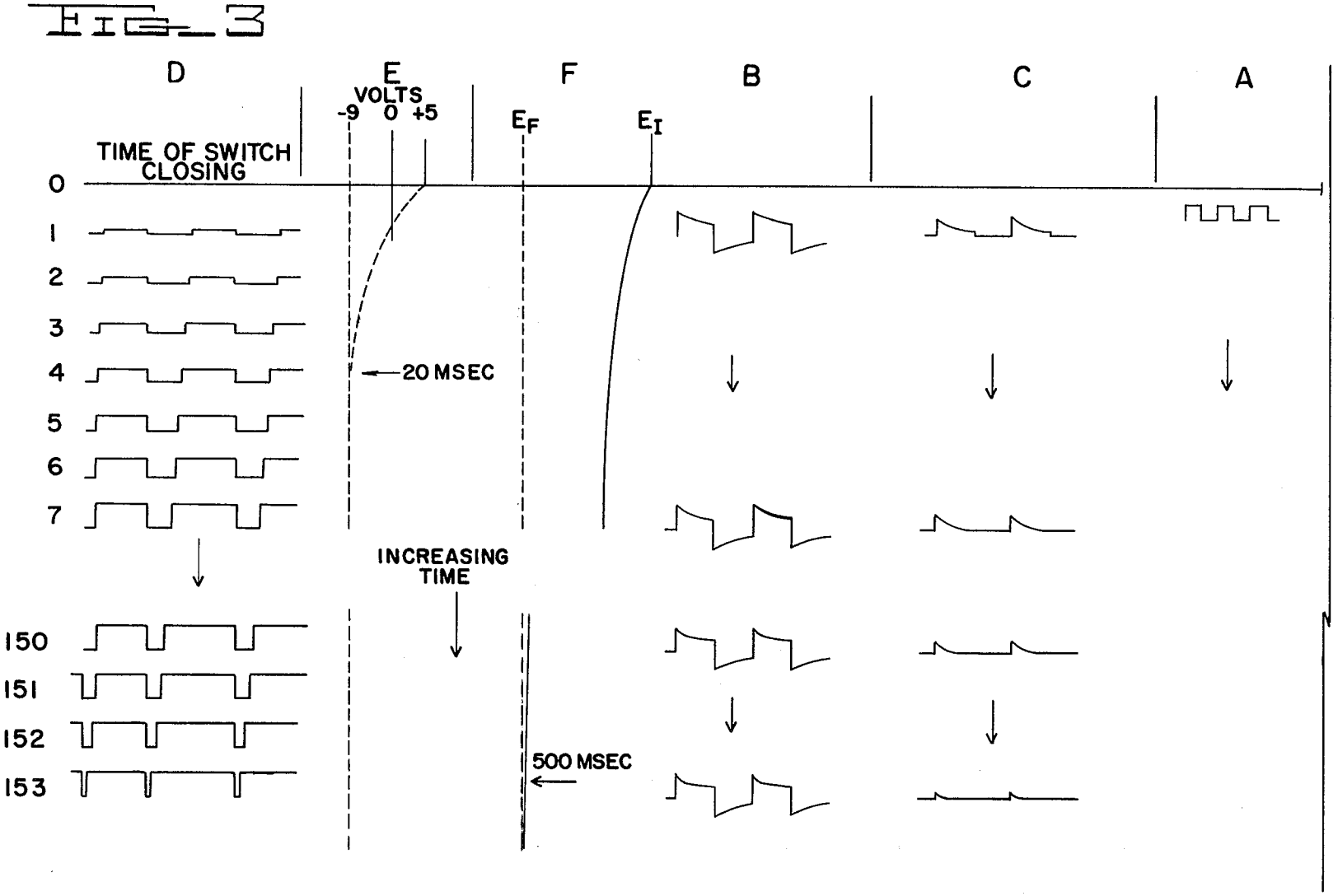
FIG. 3 is a representation of typical wave forms associated with the circuit of FIG. 2.

FIG. 1 is a block diagram representative of organ circuitry associated with, for example, the solo manual of an organ and shows the relationship of the keyer circuits pertinent to the present invention.

Solo manual 2 is connected to operate keyers 4 to pass selected ones of the outputs of tone generator 6 to the inputs of the voicing circuit 8. Voicing circuit 8 shapes the square wave signals passed by keyers 4 in accordance with the settings of tab switches 10 and supplies the shaped signals to amplifier 12 and speaker 14. The key switches from manual 2 are also connected to operate a second group of keyers 16, hereinafter referred to as brass keyers, which pass selected ones of the tone signals from tone generator 6 to an output terminal 18 which is connected to the input of amplifier 12. Line 19 connects tab switches 10 to brass keyers 16 to provide for control thereof.

Brass keyers 16, however, do not pass the square wave output or outputs of tone generator 6 to terminal 18 in the same form in which they are received, for example, as 50 percent duty cycle square waves. Rather, the square waves developed by tone generator 6 are converted to rectangular pulse trains having pulse widths which are generally narrower so as to have a duty cycle less than 50 percent and at a frequency corresponding to the selected one of the outputs of tone generator 6. Both the amplitude of the pulses and the duty cycle thereof are dynamically controlled by each of the brass keyers 16.

Referring now to FIG. 2, a single keyer 20 of brass keyer 16 is shown and is one of the several required for the range of the keyboard, each circuit 20 being operatively dedicated to a particular key and frequency. Keyer 20 comprises a diode pair 22*a* and 22*b* with their cathodes connected together at junction point 23. A bias voltage is connected to point 23 via resistor 24. Diodes 22*a* and 22*b* and resistor 24 form a gating circuit such as that described in U.S. Pat. No. 3,389,211. Thus, if a negative voltage is established at point 23, diodes 22*a* and 22*b* becomes operative so as to cause cyclic current conduction due to a voltage present at point B. As long as the voltage at point 23 is greater than the signal voltage at point B, no signal will be controlled by diodes 22*a* and 22*b*. As the voltage is established at point 23, diodes 22*a* and 22*b* become operative so as to cause cyclic current conduction due to a voltage present at point B. As long as the voltage at point 23 is greater than the signal voltage at point B, no signal will be controlled by diodes 22*a* and 22*b*. As the voltage at control point 23 is lowered, however, the diode pair 22*a* and 22*b* will go to an alternately conductive state with the controlled bias current being amplified by amplifier 26.

A capacitor 28 is connected through resistor 30 to a source of positive voltage and a second resistor 32 is connected from the junction 31 of capacitor 28 and resistor 30 to a supply of negative voltage 35 through a playing key operated switch 34. Although the connection of negative voltage supply 35 to the circuit is represented by a key switch 34, it should be noted that in the case of a more sophisticated organ, this function may be accomplished by electronic means, such as the output of the demultiplexer (not shown) in the case of multiplexed organs. Resistor 24 is connected to the common junction point 31 of resistors 30 and 32 and capacitor 28.

When switch 34 is open, a positive voltage will be developed at point 23 and will maintain a reverse bias on diodes 22*a* and 22*b* thus preventing the switching effect of the tone signal developed by tone generator 6. When switch 34 is closed, however, the positive voltage on capacitor 28 will discharge through resistor 32 and the voltage at point 23 will become more negative. As the voltage at point 23 becomes negative, diode pair 22*a* and 22*b* will alternately conduct so as to control tone signals from tone generator 6 to amplifier 26. At the instant of closure of switch 34, capacitor 28 must start to be charged from positive to negative and the rate of change is controlled by the time constant of the resistor-capacitor circuit comprising capacitor 28 and resistor 32. This has been chosen to be approximately 15 to 50 milliseconds, suitable for a desirable characteristic attack of the tone. If a source of customary square wave tone signal were present at point B, the operation of the circuit as described thus far would be as a normal keyer, with a controlled rate of amplitude buildup upon closure of the key operated switch 34.

In the circuit of the present invention, however, the square wave output of tone generator 6 is connected through a capacitor 36 to point B. Point B is also connected through resistors 38 and 40 to point 31. A capacitor 42 is connected from the junction of resistors 38 and 40 to ground and a resistor 44 connects the junction of capacitor 42 and resistors 38 and 40 to a supply of voltage at the wiper terminal of a potentiometer 46. Opposite ends of potentiometer 46 are connected to plus 5 volts and minus 5 volts, respectively. The wiper of potentiometer 46 is also connected to supply the same bias voltage to each of the others of the brass keyers 16. Capacitor 36 with resistor 38 forms a differentiating circuit, which partially differentiates the output of tone generator 6. The shape of the signal at point B will depend on the voltage on capacitor 42.

That portion of the signal at point B which is greater than one diode drop above point C (junction point 23) results in a voltage pulse at point C which causes a current flow into amplifier 26. When the voltage at point B drops to a potential less than one diode below point C, no voltage change occurs at point C and a constant valued voltage appears at D. The resulting output is a pulse wave form, the width being proportional to the slope of the differentiated wave above the aforementioned threshold at B and the bias voltages at B and C applied by resistors 38, 40, 24 and 44.

A bias voltage increase occurs at point F when switch 34 is closed but this is delayed by capacitor 42 which, together with resistor 40, has a time constant of approximately 150 milliseconds. The final voltage value at point F will be reached in about four time constants or about one-half second after switch 34 is closed and the amplitude increase of the pulse is completed. The more negative the voltage at point F, the narrower will be the width of pulse D. Conversely, the less negative the voltage at point F is, the wider will be the pulse at D. The delayed negative increase at F due to the long time constant results in an initial wide pulse as attack and a subsequent narrowing of the pulse as the capacitor 42 charges to a negative final value. Resistor 44 together with potentiometer 46 enables an overall setting to a desired final pulse width which may be utilized for desired voicing of brass instruments wherein those characterized by a very bright tonal quality will require a narrow final pulse width and those characteristic of a more mellow tonal quality will require a wider final pulse width.

The bias voltage at point F exhibits a delayed dynamic change upon keying and a static control effect for final pulse width control.

Although point 48 is shown as being preset to a selected steady value, by applying a cyclically time varying modulation signal thereto, pulse width modulation would occur without a change in the amplitude of the pulse signal. In order to obtain a muted brass tremulant effect, a cyclically time varying signal 50 may be applied to point 31 so as to result in amplitude modulation and delayed pulse width modulation of the signal (FIG. 4). Because the time constant of resistor 40-capacitor 42 is considerably longer than the time constant of resistor 32-capacitor 38, the width control bias change at point F will always lag the amplitude change bias at point E.

With reference to FIG. 3, the various wave forms developed at selected points within the circuit shown in FIG. 2 are illustrated. The wave forms in column D correspond to the square wave outputs from amplifier 26 wherein the pulse amplitude and duty cycle change from their initial values to the final values when steady state conditions have been reached. Progressing down the column with increasing time, it will be seen that the negative portions of the pulse train narrow in width as the voltage at point F decreases from the initial voltage of $E_I$ to the final voltage of $E_F$. This constitutes a gradual decrease in duty cycle which results in a change in tonal quality from a more mellow tone to a greater tone.

In column E, it will be seen that the voltage at point E decreases from an initial voltage of plus five volts to a final voltage of minus nine volts and that the final voltage is reached at approximately 20 milliseconds following the closure of switch 34. This causes the amplitude of the pulses at terminal D to increase to a final value also at approximately 20 milliseconds. It will be noted that the widest dynamic change in the control voltage at points E and F occurs during the first 20 milliseconds and that the change in pulse amplitude and duty cycle is correspondingly the greatest during this interval of time. The voltage in column F corresponds to that at point F.

In column B, the partially differentiated wave forms at point B are illustrated and show the change in voltage as a function of time with time increasing down the column similarly to the wave forms shown in column D, E and F. The wave forms in column C correspond to the voltage at point C between diodes **22*a* and 22*b*. The wave form shown in column A corresponds to the tone signal developed by tone generator six and consists of a 50** percent duty cycle square wave.

In summary, the circuit described above provides means for closely simulating the tonal quality of a brass instrument. This is accomplished not only by simulating the steady state character of the note, but also the buildup of tonal quality and amplitude from the onset of the note. The circuit accomplishes this by providing a varying pulse width control under the control of one RC timing circuit and a pulse amplitude control under the control of a second RC timing circuit. This configuration allows the circuit to produce a tone which changes from an initially mellow tonal quality to a brighter, brassy tonal quality corresponding to a change in duty cycle from a wide pulse width to a narrow pulse width at a rate somewhat slower than the increase in volume of the note.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the limits of appended claims.

What is claimed is:

1. A brass keyer system for an electronic musical instrument comprising:

an output, tone generator means for supplying a square wave signal to said output, and control means interposed between said tone generator means and said output for controlling the amplitude and duty cycle of the square wave signal supplied to said output such that the amplitude increases to a substantially final value and the duty cycle decreases to a substantially final value over a period of time with the decrease in duty cycle lagging the increase in amplitude so that the final value of the duty cycle is reached some time after the final value of the amplitude is reached.

2. The brass keyer system of claim 1 wherein the decrease in duty cycle of the square wave signal is more rapid at the beginning of the period than later in the period.

3. The brass keyer system of claim 2 wherein the increase in amplitude of the square wave signal is more rapid at the beginning of the period than later in the period.

4. The brass keyer system of claim 1 including switch means for selectively connecting said tone generator means operatively to said output and for initiating the period of time during which the amplitude and duty cycle of the square wave signal are increased and decreased, respectively.

5. A brass keyer system for an electronic musical instrument comprising:

an output, tone generator means for supplying a square wave signal to said output, and control means interposed between said tone generator means and said output for controlling the amplitude and duty cycle of the square wave signal supplied to said output such that the amplitude increases and the duty cycle decreases over a period of time with the decrease in duty cycle lagging the increase in amplitude, said control means including: electronic gate means including a control terminal for operatively connecting said tone generator means to said output in response to a control signal on said control terminal, first resistor-capicator circuit means responsive to said control signal and having a time constant controlling said gate means to increase the amplitude of the square wave signal supplied to said output at a rate corresponding to said time constant, second resistor-capacitor circuit means responsive to said control signal and having a time constant controlling said gate means to decrease the duty cycle of the square wave signal supplied to said output at a rate corresponding to the time constant of said second resistor-capacitor circuit, the time constant of one of said resistor-capacitor circuits being longer than the time constant of the other of said resistor-capacitor circuits.

6. The brass keyer system of claim 5 including an amplifier connected to said output.

7. The brass keyer system of claim 5 including playing key actuated switch means for supplying said control signal to said control terminal, said control signal being an abruptly changing DC level.

8. The brass keyer system of claim 5 wherein said gating means comprises a pair of series connected oppositely poled diodes connected in series with said tone generator means and said output and wherein said diodes have a control point therebetween connected with said control terminal.

9. A keyer system for an electronic musical instrument comprising:

a square wave signal frequency source, an output terminal, and control means interposed between said source and said output terminal and responsive to the source signal for supplying a square wave signal to said output terminal, the signal supplied to said output terminal being of the same frequency as the source signal, said control means including means for continuously changing the amplitude of the signal produced thereby in one direction to a substantially final value over a first interval of time and for continuously changing the duty cycle of the signal produced thereby in one direction to a substantially final value over a second interval of time, an end portion of said second signal being later in time than said first interval so that the final value of the duty cycle is reached later than the final value of the amplitude.

10. The keyer system of claim 9 including means for adjusting the final value of the duty cycle.

11. A keyer system of claim 9 including playing key actuated switch means for actuating said control means and for initiating said intervals, said control means increasing the amplitude and decreasing the duty cycle of the square wave signal supplied to said output terminal over said intervals.

12. The keyer system of claim 9 wherein said control means includes means for cyclically varying the amplitude and duty cycle of the square wave signal supplied to said output terminal, the change in duty cycle lagging the change in amplitude.

13. A keyer system for an electronic musical instrument comprising:

a square wave signal frequency source, an output terminal, and control means interposed between said source and said output terminal and responsive to the source signal for supplying a square wave signal to said output terminal, the signal supplied to said output terminal being of the same frequency as the source signal, said control means including means for continuously changing the amplitude of the signal produced thereby in one direction over a first interval of time and for continuously changing the duty cycle of the signal produced thereby in one direction over a second interval of time, at least a portion of said second interval being delayed in time from said first interval, said control means further comprising: electronic gate means including a control terminal for operatively connecting said square wave frequency source to said output terminal in response to a control signal on said control terminal, first resistor-capacitor circuit means responsive to said control signal and having a first time constant for controlling said gate means to change the amplitude of said square wave signals supplied to said output terminal at a rate corresponding to the first time constant, and second resistor-capacitor circuit means responsive to said control signal and having a second time constant for controlling said gate means to change the duty cycle of the square wave signal supplied to said output terminal at a rate corresponding to the second time constant, said first and second time constants differing from each other.

14. A keyer system of claim 13 including playing key actuated switch means for producing said control signal, said control signal being an abrupt change in DC level.

15. The keyer system of claim 13 wherein said control signal is a cyclically time varying signal.

16. The keyer system of claim 13 wherein said gate means comprises a pair of series connected oppositely poled diodes connected in series with said source and said output terminal, and including means for partially differentiating the square wave signal from said source.

17. The keyer system of claim 16 wherein said second resistor-capacitor circuit means includes means for changing the degree of differentiation over the second interval of time.

18. In an electronic organ, the method of producing a muted brass effect comprising:

providing a source of square wave frequency to an output terminal when a playing key is depressed, causing the amplitude of the square wave frequency to increase, upon the depression of a playing key, in an incremental fashion to a final amplitude, and causing the duty cycle of the square wave frequency to decrease in incremental fashion to a final duty cycle value which is reached some time after the final amplitude in reached.

19. The method of claim 18 wherein the duty cycle begins to decrease upon the depression of the playing key.

20. The method of claim 19 wherein the change in duty cycle is more rapid initially following the depression of the playing key than later.

21. The method of claim 20 wherein the change in amplitude is more rapid initially following the depression of the playing key than later.

22. In an electronic organ, the method of producing a muted brass effect comprising:

providing a source of square wave frequency to an output terminal, causing the amplitude of the square wave frequency to change in one direction to a substantially final value over an interval of time, and causing the duty cycle to change in one direction to a substantially final value over an interval of time, the change in duty cycle lagging the change in amplitude so that the final value of the duty cycle is reached sometime after the final value of the amplitude is reached.

23. The method of claim 22 and causing the amplitude and duty cycle of the square wave frequency to change in one direction and then to change in the other direction in cyclic fashion so as to produce a termulant effect.

* * * * *

UNITED STATES PATENT AND TRADEMARK OFFICE

CERTIFICATE OF CORRECTION

PATENT NO. : 4,203,339

DATED : May 20, 1980

INVENTOR(S) : Alan B. Welsh and John W. Robinson

It is certified that error appears in the above-identified patent and that said Letters Patent are hereby corrected as shown below:

Claim 23, Column 8, Line 67, "termulant" should be --tremulant --.

Signed and Sealed this

*Twenty-third* Day of *September 1980*

[SEAL]

*Attest:*

SIDNEY A. DIAMOND

*Attesting Officer*

*Commissioner of Patents and Trademarks*